US005772408A

United States Patent [19]

Hada et al.

[11] Patent Number: 5,772,408

[45] Date of Patent: Jun. 30, 1998

[54] POWER UNIT HOUSING A PUMP

[75] Inventors: Kimio Hada; Hirotake Hanamura, both of Tokyo, Japan

[73] Assignee: Nikko Electric Industry Co., Ltd., Tokyo, Japan

[21] Appl. No.: 659,252

[22] Filed: Jun. 7, 1996

[30] Foreign Application Priority Data

Nov. 27, 1995 [JP] Japan ..... 7-307399

[51] Int. Cl.[6] ..... F04B 23/02

[52] U.S. Cl. ..... 417/313

[58] Field of Search ..... 417/313

[56] References Cited

U.S. PATENT DOCUMENTS

| | | | |
|---|---|---|---|
| 3,982,856 | 9/1976 | Hehl | 417/360 |
| 4,057,368 | 11/1977 | Balling | 417/313 |
| 4,325,678 | 4/1982 | Kanamaru et al. | 417/313 |
| 4,704,747 | 11/1987 | Brubakken et al. | 4/321 |
| 5,104,294 | 4/1992 | Banba . | |
| 5,306,421 | 4/1994 | Weinstein | 210/151 |
| 5,310,481 | 5/1994 | Rondano | 210/86 |
| 5,378,119 | 1/1995 | Goertzen | 417/313 |
| 5,695,259 | 12/1997 | Isshiki et al. | 303/119.2 |

FOREIGN PATENT DOCUMENTS

| | | |
|---|---|---|
| 37 09 477 | 12/1987 | Germany . |
| 38 39 689 | 5/1990 | Germany . |
| 2 027 283 | 2/1980 | United Kingdom . |

OTHER PUBLICATIONS

Northern Fall/Winter Catalog, PO Box 1499, Burnsville MN 55337–0499, p. 85 (L–shaped tanks), 1997.

*Primary Examiner*—Timothy Thorpe
*Assistant Examiner*—Ehud Gartenberg
*Attorney, Agent, or Firm*—Wenderoth, Lind & Ponack, L.L.P.

[57] ABSTRACT

A power unit housing a pump, comprising: a hydraulic oil tank having an approximately L-shaped configuration and including a pump housing portion which houses a hydraulic pump and an oil reservoir portion which is integrally formed with and arranged approximately perpendicular to the pump housing portion; an electric motor juxtaposed alongside the oil reservoir portion, the electrical motor operating the hydraulic pump through a direct coupling; and a switching valve for switching the supply and discharge flow of the hydraulic oil between the hydraulic pump and an external load, the switching valve is positioned in proximity to the electric motor. According to this arrangement it is possible to shorten the axial length of the hydraulic oil tank while maintaining the volume of the tank and it is possible to make the entire unit compact.

7 Claims, 5 Drawing Sheets

POWER UNIT HOUSING A PUMP

BACKGROUND OF THE INVENTION

1. Field of the Art

The present invention relates to a power unit housing a pump, wherein the hydraulic oil tank, which houses the hydraulic pump, is formed into an L-shaped configuration and the entire unit of which has been made compact.

2. Prior Art

A typical conventional power unit 1 is shown in FIGS. 5 and 6. The power unit has a hydraulic pump 2 affixed inside a hydraulic oil tank 3, and switching valve 4 which switches the flow of the hydraulic oil between the external load (not shown) such as a hydraulic cylinder and the hydraulic pump 2. The switching valve 4 is directly connected to the hydraulic pump 2 without the need for intake piping or a discharge piping, and as a result, the leakage of hydraulic oil within the unit can be prevented. An electric motor 5 which operates hydraulic pump 2 is positioned on an extension line in the longitudinal direction of the thin-walled cylindrical hydraulic oil tank 3, and the switching valve 4 is positioned directly above this electric motor 5.

When the switching valve 4 distributes hydraulic oil to the oil chamber on either side of the piston within the hydraulic cylinder, i.e., the external load, the oil flow is switched by magnetizing and demagnetizing the solenoid portion 4*a*. The reference numeral 6 is a switch for operating the electric motor 5 and the switching valve 4, and to this end, it is connected to the electric motor 5 and switching valve 4 by means of cord 7.

The main components of the unit, such as the hydraulic oil tank 3 and electric motor 5, are mounted on top of the base 8, and all components of the unit are surrounded by a cover 9 which is openable at the front and top portions thereof. On the rear side of the cover 9, there are two openings for ports A and B of switching valve 4. The operational portion of key switch 6' extrudes from the side of the cover 9. Also, the front and top portions of the unit are covered by a removable cover portion 9' which is attached to the side portions of the cover 9 by means of screw 10 on either side thereof.

When the switch 6 is closed, the electric motor 5 is activated, and the hydraulic pump 2 which is directly coupled to the electric motor 5 via coupling 5*a* is driven. During operation of the hydraulic pump 2, the hydraulic oil within the hydraulic oil tank 3 is sucked into hydraulic pump 2 via intake opening 2*a*, and discharged from port A (or port B) via switching valve 4 which is directly coupled to hydraulic pump 2. The discharged hydraulic oil is supplied to an oil chamber on one side of the hydraulic cylinder and drives the piston in a reciprocating manner, and the hydraulic oil discharged from the other oil chamber by means of the piston is returned to the switching valve 4 via port B (or port A) and is sent back to the hydraulic oil tank 3. In this case, since the hydraulic pump 2 is built into the hydraulic oil tank 3, and the switching valve 4 is directly connected to hydraulic pump 2 without the need for any intake or discharge piping, unless a worst case scenario such as breakage of operating-oil tank 3 happens, there would be no leakage of hydraulic oil.

In the aforementioned conventional power unit 1, however, since the thin-walled cylindrical form hydraulic oil tank 3 housing the hydraulic pump 2 and the electric motor 5 are positioned along a mutual straight line, the length of the unit is determined by the sum of the length of the hydraulic oil tank 3 and the length of electric motor 5. For this reason, the length of the unit can not be made shorter than the sum of the length of the hydraulic oil tank 3 and the length of electric motor 5; which makes the size of the unit relatively large.

Also, all of the components of the power unit 1 are covered with a removable cover 9 that opens at the front and the top portions and the base 8, and the components are completely surrounded by cover 9. Thus, the cover 9 tends to be large; which makes the manufacturing costs relatively high.

SUMMARY OF THE INVENTION

Therefore, an object of the present invention is to provide a power unit housing a pump, wherein the hydraulic oil tank housing the hydraulic pump has a particular shape, which enables the entire unit to be compact, and also the size of the cover to be made relatively small.

According to the present invention, the aforementioned objectives are accomplished by a power unit housing a pump, which comprises: a hydraulic oil tank having an approximate L-shaped configuration and including a pump housing portion which houses a hydraulic pump therein and an oil reservoir portion which is integrally formed with and disposed approximately perpendicular to the pump housing portion; an electric motor juxtaposed alongside the oil reservoir portion, the electrical motor operates the hydraulic pump through a direct coupling; and a switching valve for switching the supply and discharge of the hydraulic oil between the hydraulic pump and an external load; said switching valve being positioned in the proximity of said electric motor.

Further, the present invention attains the aforementioned objectives by provision of a power unit housing a pump, wherein a portion of the outer wall of the aforementioned hydraulic oil tank forms a portion of the outer wall of the unit, and the outer wall portion of the unit other than the portion formed by the outer wall of said hydraulic oil tank is formed by a removable cover; or by provision of a power unit housing a pump, wherein the aforementioned switching valve is directly connected to the hydraulic pump, without using intake piping or discharge piping.

According to the present invention, hydraulic oil tank is formed in an L-shaped configuration, wherein the pump housing portion and the oil reservoir portion are integrally formed and the electric motor is juxtaposed alongside the oil reservoir portion. Thus, the length of the hydraulic oil tank can be substantially shortened while keeping the necessary volume for the hydraulic oil tank, and consequently the dimensions of the entire power unit can be made smaller. Further, a compact combination of the hydraulic oil tank and the electric motor occupies the least installation space, which thus reduces the overall volume of the unit.

Further, in the present invention, a portion of the outer wall of the hydraulic oil tank forms a portion of the outer wall of the unit, and the outer wall portion of the unit which is not formed by the outer wall of the hydraulic oil tank is covered with a removable cover. Therefore, the cover can be made much smaller, and the manufacturing costs can be reduced accordingly.

The above and other objects, features and advantages of the present invention will become more apparent from the following description when taken in conjunction with the accompanying drawings in which a preferred embodiment of the present invention is shown by way of illustrative examples.

PREFERRED EMBODIMENT OF THE INVENTION

Figure 1:
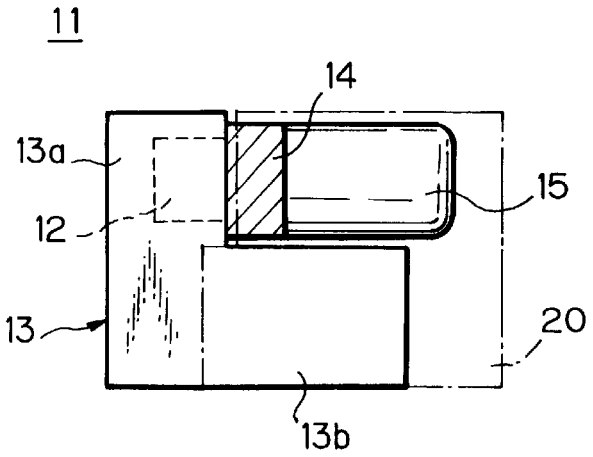
FIG. 1 is a schematic plan view showing a power unit housing a pump according to an embodiment of the present invention.
Figure 2:
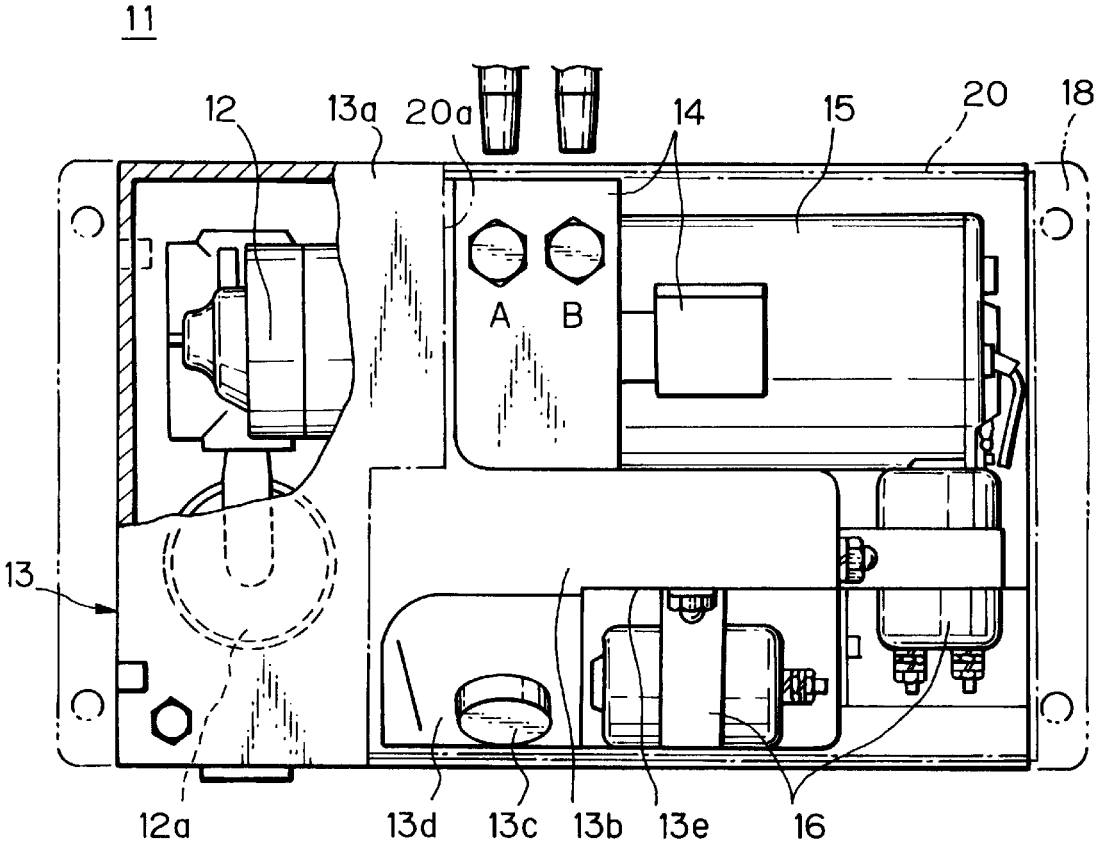
FIG. 2 is a partial cross-section plan view showing the details of the power unit housing the pump shown in FIG. 1.
Figure 3:
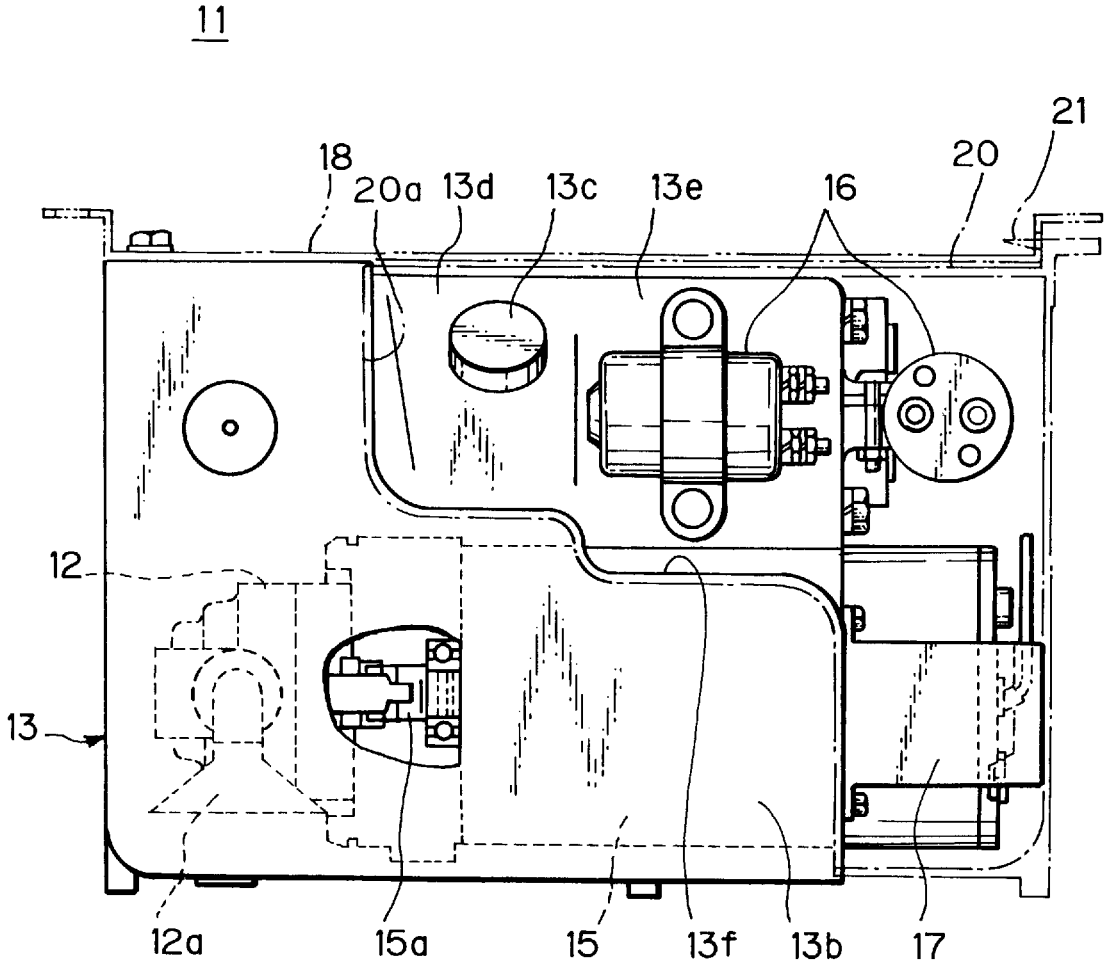
FIG. 3 is a partial cross-section front view showing the details of the power unit housing the pump shown in FIG. 1.
Figure 4:
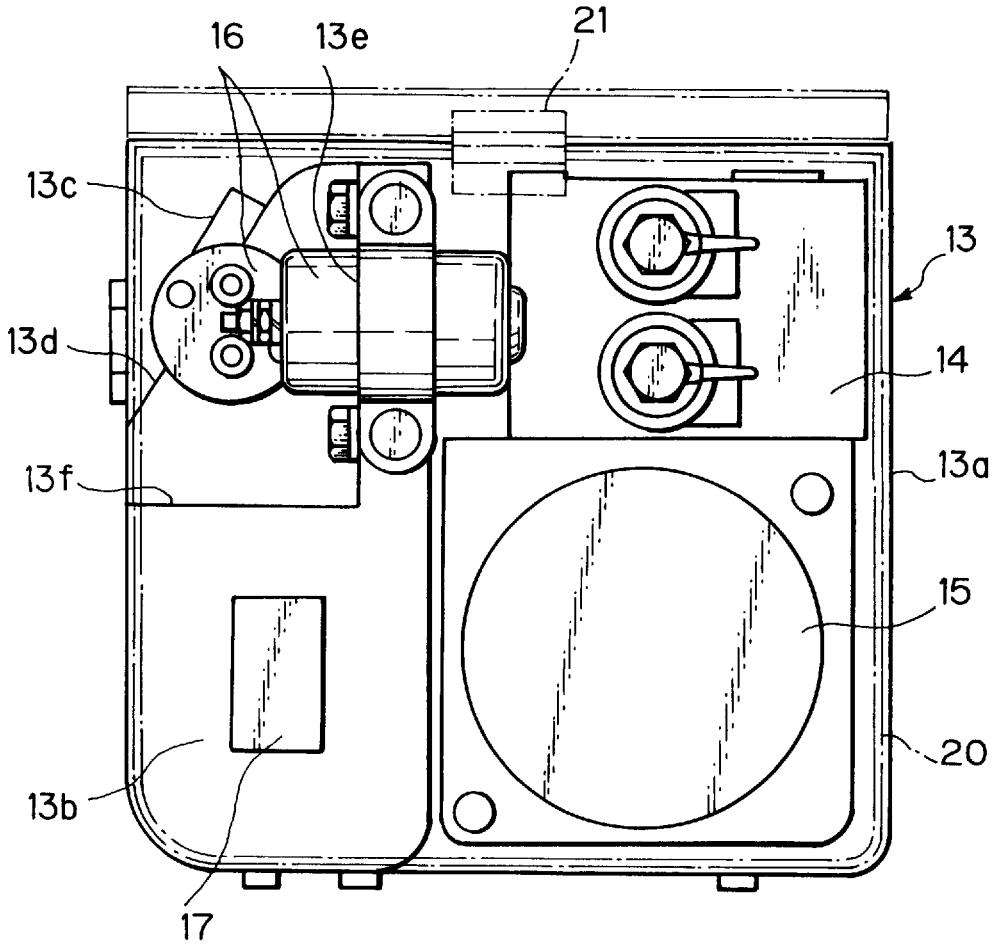
FIG. 4 is a partially simplified side view of the details of the power unit housing the pump shown in FIG. 1.
Figure 5:
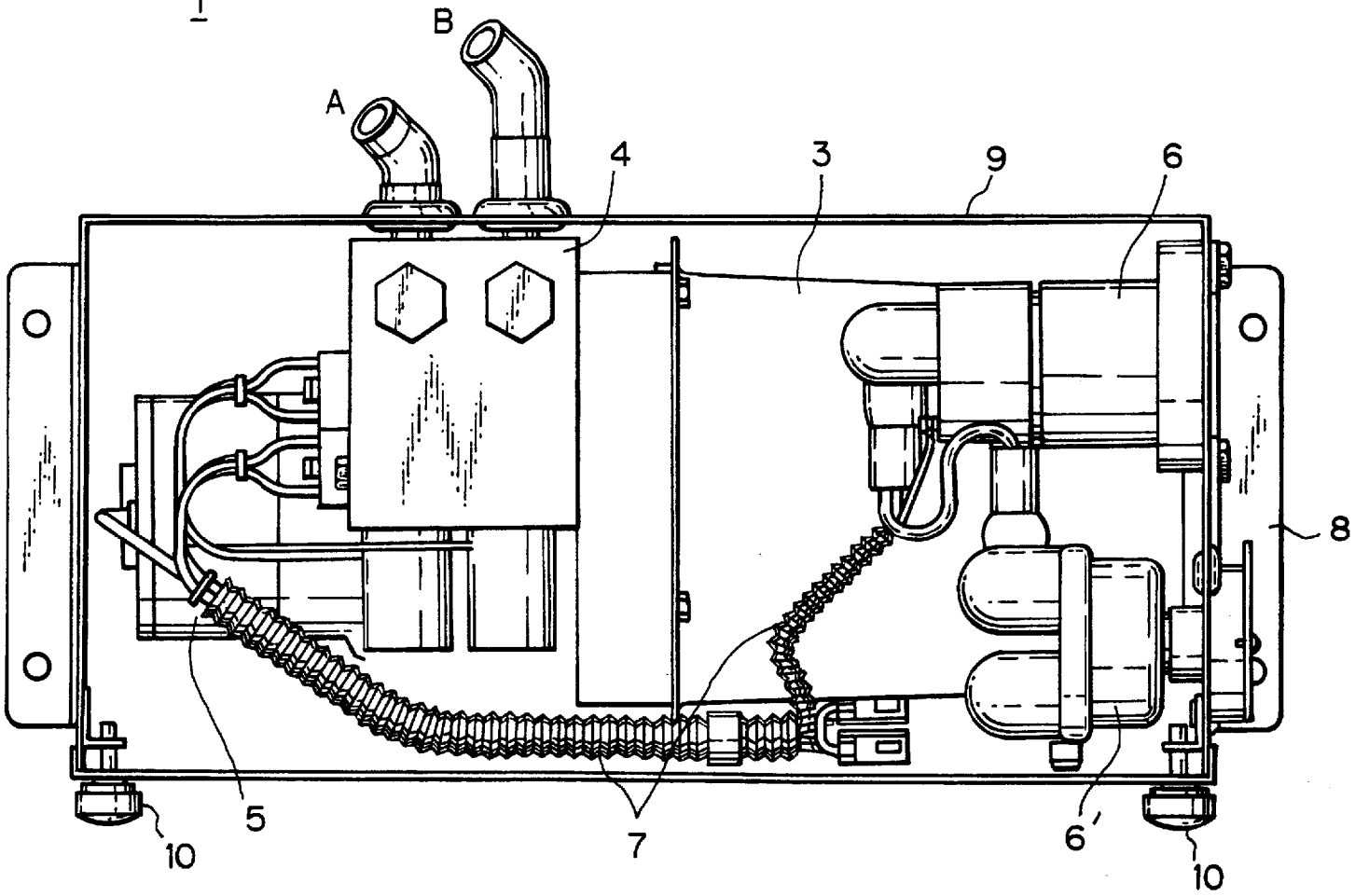
Fig. 5 PRIOR ART
FIG. 5 is a partial cross-section plan view showing an example of a conventional power unit housing a pump.
Figure 6:
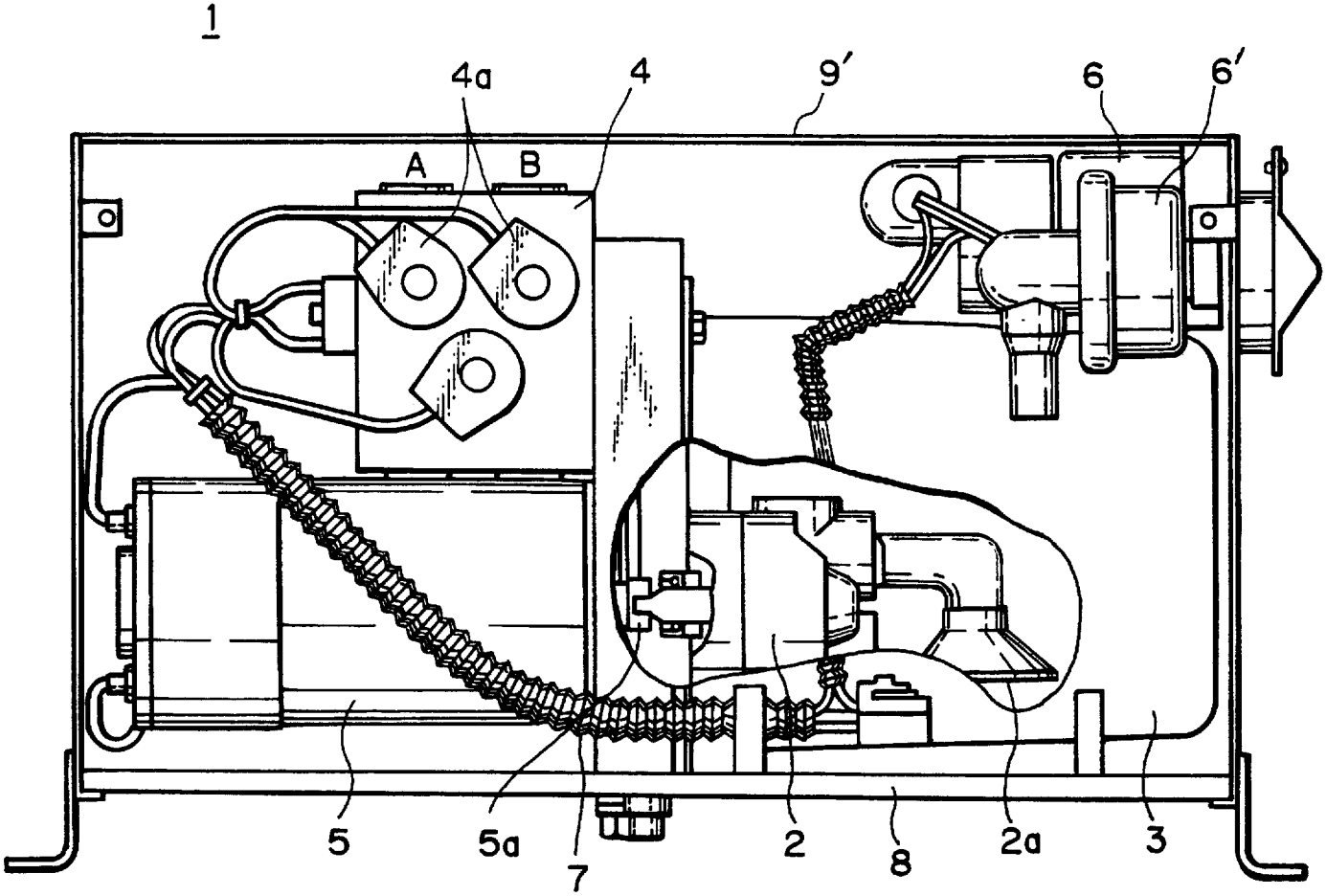
Fig. 6 PRIOR ART
FIG. 6 is a partial cross-section front drawing of the power unit housing a pump shown in FIG. 5.

The following is a description of one embodiment of the present invention, based on FIGS. 1 through 4. FIG. 1 is a schematic plan view showing a power unit housing a pump according to an embodiment of the present invention; FIG. 2 is a partial cross-section plan view showing the details of the power unit housing the pump shown in FIG. 1; FIG. 3 is a partial cross-section front view showing the details of the power unit housing the pump shown in FIG. 1; FIG. 4 is a partially simplified side view showing the details of the power unit housing the pump shown in FIG. 1.

The main feature of the power unit 11 housing the pump is in that the length of the unit has been shortened in the axial or longitudinal direction by forming the hydraulic oil tank 13 into an approximate L-shaped configuration while maintaining the necessary total volume of space for the hydraulic oil tank, as illustrated in FIG. 1. Specifically, the hydraulic oil tank 13 includes a pump housing portion 13*a* having a hydraulic pump 12 built thereinto and an oil reservoir portion 13*b* of a hollow area, which is disposed perpendicular to the pump housing portion 13*a*. The outer wall of the hydraulic oil tank is manufactured with strong cast aluminum so that a portion of the outer wall can form a part of the outer wall of the unit. An electric motor 15 which operates the hydraulic pump 12 via coupling 15*a*, is juxtaposed alongside the oil reservoir portion 13*b*, and thereby the substantial portion of the hydraulic oil tank 13 is positioned adjacent to electric motor 15. Thus, the length of the hydraulic oil tank 13 in the axial direction is greatly reduced. Slanted portion 13*d* for the purpose of attaching oil supply plug 13*c*, and vertical portion 13*e* for the purpose of attaching one of the magnet-switches 16 are formed adjacent to each other on oil reservoir portion 13*b*, which is adjacent to motor 15. Slanted portion 13*d* and vertical portion 13*e* are formed on the top half of oil reservoir portion 13*b*. A step portion 13*f* is formed at the bottom of the vertical portion 13*e*. A switching valve 14 is positioned directly above motor 15 and is directly coupled to the hydraulic pump 12 as in the prior art, whereby piping within the unit such as intake piping or discharge piping which may cause leakage is completely omitted.

Since the hydraulic oil tank 13 is fabricated from a strong aluminum alloy and forms a portion of the outer wall of the unit (on the left side of the one dot chain line in FIGS. 2 and 3), the area necessary for covering by the cover 20 (shown in FIGS. 1 through 4 encircled by one dot chain lines) is the remaining portion other than the portion of the outer wall of the unit which is formed by the hydraulic oil tank 13. Therefore, as shown by one dot chain lines in FIGS. 2, 3 and 4, the cover 20 which covers the exposed parts such as the electric motor 15, the switching valve 14, the magnet-switch 16, the oil supply plug 13*c*, the main switch 17, can be made much smaller in plan view than the size of the base 18, which is the supporting base of power unit 11. The aforementioned cover 20 can easily be removably secured by means of snaps, screws, or both, or other means, to the hydraulic oil tank 13 and the base 18 at the adjacent portions therebetween (the diagram shows an example of an insertion-type snap 21). Further, in the embodiment of the diagram, the hydraulic oil tank 13 and cover 20 are mounted onto the underside of the base 18 in a suspended manner.

In addition, the leading edge of the cover 20 is received in a groove 20*a* formed in the tank 13 to support the cover on the tank.

Regarding the operation of the power unit of the present embodiment, when the main switch 17 is operated and magnet switches 16 are turned to the extension motion side of the piston (or the retraction motion side of the piston), the electric motor 15 is activated, and the hydraulic pump 12 begins to operate. As the hydraulic pump 12 operates, the operating-oil within the hydraulic oil tank 13 is sucked into the hydraulic pump 12 via intake opening 12*a*, and is discharged from port A (or port B) via the switching valve 14 which is directly coupled to the hydraulic pump 12. The discharged oil is supplied to an oil chamber on one side of the hydraulic cylinder (not shown in the Figure) and drives the piston; on the other side, the hydraulic oil discharged from the other oil chamber by means of the piston is returned to the switching valve 14 via port B (or port A), and is sent back to the hydraulic oil tank 13. In this case, since the hydraulic pump 12 is built into the hydraulic oil tank 13, and the switching valve 14 is directly connected to the hydraulic pump 12 without the need for any intake or discharge piping, unless a worst case scenario such as breakage of the hydraulic oil task 13 happens, there would be no leakage of the hydraulic oil within the power unit 11. However, since the hydraulic oil tank 13 is constructed with strong cast aluminum, it is highly unlikely to break. Therefore, the durability of the hydraulic oil tank 13 is increased and the possibility of leakage in the power unit 11 is accordingly decreased as compared with the conventional power unit.

As stated above, the power unit 11 housing a pump comprises: a hydraulic oil tank 13 of an approximate L-shaped configuration, which includes a pump housing portion 13*a* housing a hydraulic pump 12 therein and an oil reservoir portion 13*b* which is integrally formed with and arranged approximately perpendicular to the pump housing portion 13*a*; an electric motor 15 juxtaposed alongside the oil reservoir portion 13*b*, the electrical motor 15 operating said hydraulic pump 12 through a direct coupling; and a switching valve 14 for switching the supply and discharge flow of the hydraulic oil between the hydraulic pump 12 and an external load, the switching valve 14 being positioned in proximity to the electric motor 15. The hydraulic oil tank 13 is not shaped as a straight thin-walled cylinder. Rather, it is fabricated by disposing the pump housing portion 13*a* and the oil reservoir portion 13*b* in a bent L-shape, and the substantial portion of the hydraulic oil tank is placed adjacent to the electric motor. Thus, the axial length of the hydraulic oil tank 13 can substantially be shortened while maintaining the necessary volume for the tank and consequently, the overall dimensions of the power unit can be reduced. Further, since the oil reservoir portion 13*b* is positioned adjacent to electric motor 15, the hydraulic oil tank 13 can be disposed so that the space for installing the tank and the motor is minimized, and hence the unit can be made more compact. Furthermore, by fabricating the hydraulic oil tank 13 out of cast aluminum, etc., manufacture thereof can be conducted economically and effectively, while also providing increased lightness and strength.

Moreover, a portion of the outer wall of the hydraulic oil tank 13 forms a portion of the outer wall of the unit, and the outer wall portion of the unit other than the portion formed by the hydraulic oil tank 13 is covered by a removable cover 20. Therefore, unlike the conventional power unit 1 housing a pump, in which the entire hydraulic oil tank 3 is positioned on the extension line of the electric motor 5 and, thus, the casing 9 and cover 10 inevitably become too large, the cover 20 can be made smaller, and manufacturing costs can be reduced.

Moreover, since the switching valve 14 is directly coupled to the hydraulic pump 12 without using any intake or discharge piping, and since the sealing effects are provided by housing the hydraulic pump 12 inside the hydraulic oil tank 13, oil leakage accidents within the unit can be eliminated.

As described above, in the present invention, the hydraulic oil tank is not formed as a straight thin-walled cylinder but is rather formed to have an L-shaped configuration by integrally forming the pump housing portion with the oil reservoir portion, and the electric motor is juxtaposed alongside the oil reservoir portion. Therefore, the length of the hydraulic oil tank can be substantially shortened while maintaining the necessary volume for the hydraulic oil tank, and consequently the dimensions of the entire power unit can be reduced. Further, a compact disposition of the hydraulic oil tank and the electric motor requires the least installation space, thereby making it possible to reduce the volume of the entire unit. In particular, by fabricating the hydraulic oil tank with cast aluminum, etc., the hydraulic oil tank can be improved so as to have optimal form thereby avoiding the wasted space, and have improved lightness and strength.

Further, the present invention uses a portion of the outer wall of the hydraulic oil tank as a portion of the outer wall of the unit, and a portion of the unit which is not formed by the outer wall of the hydraulic oil tank is covered with a removable cover. Thus, the cover can be made smaller, and the manufacturing costs can be reduced accordingly.

What is claimed is:

1. A power unit housing a pump, comprising: a hydraulic oil tank having an approximately L-shaped configuration and including a pump housing portion which houses a hydraulic pump and an oil reservoir portion which is integrally formed with and arranged approximately perpendicular to said pump housing portion; an electric motor juxtaposed alongside said oil reservoir portion, said electrical motor operates said hydraulic pump through a direct coupling; and a switching valve for switching the supply and discharge flow of the hydraulic oil between said hydraulic pump and an external load, said switching valve being positioned proximate to said electric motor.

2. A power unit housing a pump according to claim 1, wherein a portion of the outer wall of said hydraulic oil tank forms a portion of the outer wall of the unit, and the outer wall portion of the unit other than the portion formed by the outer wall of said hydraulic oil tank is covered by a removable cover.

3. A power unit housing a pump according to claim 1, wherein said switching valve is connected by direct coupling to said hydraulic pump not via intake or discharge piping.

4. A power unit housing a pump according to claim 2, wherein said hydraulic oil tank and said cover are mounted on and suspended from the underside of a base plate which forms the top portion of the outer wall of said unit.

5. A power unit housing a pump according to claim 4, wherein said cover is removably secured to said hydraulic oil tank and said base plate at the adjacent portions therebetween by means of snaps, screws or both, or other fastening means.

6. A power unit housing a pump according to claim 1, wherein the outer wall of said hydraulic oil tank is formed from a cast aluminum.

7. A power unit housing a pump according to claim 1, wherein said switching valve is positioned above said electric motor.

* * * * *